United States Patent [19]

Stephen

[11] Patent Number: 5,048,131

[45] Date of Patent: Sep. 17, 1991

[54] ADJUSTABLE ASSIST STAND FOR AN ELEVATED SPA

[76] Inventor: Gordon R. Stephen, 4331 Stonewood Ct., Santa Maria, Calif. 93455

[21] Appl. No.: 587,212

[22] Filed: Sep. 24, 1990

[51] Int. Cl.[5] ..... A47K 3/00; A47K 3/12

[52] U.S. Cl. ..... 4/559; 4/576

[58] Field of Search ..... 4/571, 576, 560, 611, 4/496, 504, 511, 564, 542, 543, 544, 559; 248/125, 161

[56] References Cited

U.S. PATENT DOCUMENTS

| | | | |
|---|---|---|---|
| 2,063,864 | 12/1936 | Zinkil | 4/185 |
| 2,549,506 | 4/1951 | Moore | 4/185 |
| 2,756,439 | 7/1956 | Bollen | 4/185 |
| 3,088,123 | 5/1963 | Loughridge | 4/496 |
| 3,256,036 | 6/1966 | Nolan | 4/564 |
| 3,390,740 | 7/1968 | Brandel et al. | 182/113 |
| 3,448,468 | 6/1969 | Murcott | 4/185 |
| 3,507,402 | 4/1970 | Barbee | 248/125 |
| 3,604,019 | 9/1971 | Garner | 4/195 H |
| 3,804,355 | 4/1974 | Uroshevich | 248/125 |
| 3,908,795 | 9/1975 | Gannon | 182/118 |
| 3,968,524 | 7/1976 | Zentman | 4/185 H |
| 4,075,719 | 2/1978 | Sullivan | 4/564 |
| 4,240,603 | 12/1980 | Chiariello | 248/125 |
| 4,253,203 | 3/1981 | Thomas | 4/559 |
| 4,417,361 | 11/1983 | Smith | 4/577 |
| 4,498,204 | 2/1985 | Warner | 4/559 |
| 4,512,042 | 4/1985 | Striegel et al. | 4/496 |
| 4,527,297 | 7/1985 | Pettit | 4/496 |
| 4,588,155 | 5/1986 | James | 4/504 |
| 4,628,550 | 12/1986 | Walton | 4/559 |
| 4,666.111 | 5/1987 | Schuler | 248/125 |
| 4,892,279 | 1/1990 | Lafferty et al. | 248/125 |

FOREIGN PATENT DOCUMENTS

| | | | |
|---|---|---|---|
| 1907229 | 9/1970 | Fed. Rep. of Germany | 4/576 |
| 2557791 | 7/1985 | France | 4/559 |
| 120918 | 2/1948 | Sweden | 248/161 |
| 2203128 | 10/1988 | United Kingdom | 4/571 |

*Primary Examiner*—Allan N. Shoap
*Assistant Examiner*—Diego F. F. Gutierrez
*Attorney, Agent, or Firm*—Marvin E. Jacobs

[57] ABSTRACT

A user assist stand for an above-floor level spa has an elongated main tubular member secured upright on a base plate fastened to the floor and an auxiliary extension member slidably interfitting in telescoping relation within an open top end of the main member such that an upper portion of the auxiliary member extends upwardly from main member. A hand grip is mounted to the upper portion of the auxiliary member. A release lock mechanism in the form of a shaft having a pull ring is inserted through aligned holes in the main and auxiliary members for securing the auxiliary member to the main tubular member to position the upper portion of the auxiliary member and the hand grip thereon at a desired elevation above the main member and relative to an upper edge of a spa. The shaft of the release lock mechanism also is removable from the main and auxiliary members for releasing the auxiliary member to permit slidably moving the auxiliary member to vertically adjust of the position of the hand grip relative to the main member and spa. A swivel lock mechanism mounts the hand grip to the upper portion of the auxiliary member and is operable to permit pivotal movement of the hand grip between an extended position in which it overlies the upper edge of the spa sidewall and a retracted position in which it is offset outside of a vertical plane of the sidewall of the spa.

18 Claims, 3 Drawing Sheets

ADJUSTABLE ASSIST STAND FOR AN ELEVATED SPA

CROSS REFERENCE TO DISCLOSURE DOCUMENT

Disclosure Document No. 245,321 which discloses the subject invention was filed on Feb. 12, 1990.

BACKGROUND OF THE INVENTION

The present invention generally relates to devices for assisting persons in getting into and out of ordinary hot tubs or spas elevated above floor or deck level and, more particularly, is concerned with a user assist stand adjustable to different spa heights and to accommodate deployment of a spa cover during periods of nonuse.

Elevated spas are currently in wide use by the general public. Due to ordinary construction and the environment of use of spas, the top edges of their sidewalls can be up to eight inches in width and normally have surfaces which are wet and slippery. These conditions make forming a firm grip by a user's hand on the top edges of spas nearly impossible. Additionally, the majority of spas have uneven sloping floors or bottom walls which further contribute to a slippery environment.

As of the present time there does not appear to be an acceptable industry-wide device for assisting users in getting into and out of spas. In many instances, buyers of spas are initially provided with an unattached two-step or three-step structure. This attempt to provide the spa user with easier access over a spa sidewall which may approach thirty-six inches in height falls far short of an acceptable standard of user safety and convenience.

Various devices have been proposed in the prior patent art for assisting users of bathtubs in entering and exiting the tub. Representative of the prior art are the devices disclosed in U.S. Pat. Nos. (2,063,864) to Zinkil, Moore (2,549,506), Bollen (2,756,439) Murcott (3,448,468), Garner (3,604,019), Zentman (3,968,524) and Smith (4,417,361). All of these prior art devices appear to have one or more drawbacks which render them inadequate or unsatisfactory for use with above-deck level spas.

For instance, some of the prior art devices are intended to be permanently installed on the side of a bathtub so as to be available for use whenever needed. In the case of a spa, such permanent installation would interfere with normal care and maintenance of the spa by preventing deployment of a thermal cover over the spa which is typically used to keep the water clean and retain heat during periods of non-use. Further, many of the prior art devices are not readily adjustable to fit spas and users of different heights and sizes.

One prior art device for a spa is disclosed in U.S. Pat. No. 4,512,042 to Striegel et al. It is a handrail which is permanently attached to the spa and also serves as a conduit for pressurized air. This device embodies the same drawbacks as the bathtub devices discussed above and thus is unsatisfactory also.

Consequently, a need exists for a device more particularly tailored for use with above-deck level spas to assist users in getting into and out of the spa while accommodating variations in size of users and spas and the requirements for maintenance and care of the spa.

SUMMARY OF THE INVENTION

The present invention provides a user assist stand designed to satisfy the aforementioned needs. The user assist stand of the present invention is specifically tailored for spa use, being adjustable to different spa and user heights and to accommodate spa maintenance and care, such as deployment of a cover over the spa during periods of nonuse. Also, advantageously, the assist stand of the present invention has only a few parts and a relatively simple construction, is easy to adjust to fit the height of the spa and user, and has a user handle grip which is easy to use and to convert between non-use and use positions.

Accordingly, the present invention is directed to a user assist stand for use with an above-floor level spa. The assist stand comprises: (a) an elongated main hollow tubular member having an open top end; (b) means for securing the main member to a floor and extending upright adjacent an exterior side of a sidewall of a spa; (c) an elongated auxiliary extension member slidably interfitting in telescoping relation within the main member through the open top end thereof such that an upper portion of the auxiliary member is disposed upwardly from the main member; (d) a hand grip mounted to the upper portion of the auxiliary member; and (e) a release lock mechanism operable for securing the auxiliary member to the main member to position the upper portion of the auxiliary member and the hand grip mounted thereon at a desired elevation above the main member and relative to an upper edge of the spa sidewall. The release lock mechanism also is operable for releasing the auxiliary member from securement to the main member to permit slidable movement of the auxiliary member relative to the main member and thereby adjustment of the elevation of the upper portion of the auxiliary member and the hand grip thereon relative to the main member and to the spa sidewall upper edge.

More particularly, a swivel lock mechanism is provided for mounting the hand grip to the upper portion of the auxiliary member so as to permit pivotal movement of the hand grip between an extended position in which it overlies a portion of the upper edge of the spa sidewall and a retracted position in which it is offset away from and outside of a vertical plane defined by the sidewall of the spa. The swivel lock mechanism includes a housing, a first shaft fixed to the housing, and a second hollow shaft inserted over the first shaft and rotatable relative thereto and having the hand grip attached thereon for pivoting with rotation of the second shaft. Also, means are provided for latching the hand grip at its retracted position and being releasable for permitting pivotal movement of the hand grip to the extended position. The latching means includes a first latch element fixed to the rotatable shaft and having a notch defined therein, a second flexible latch element mounted to the housing adjacent the first latch element and movable between latching and releasing positions relative to the notch of the first latch element. An actuating lever is pivotally mounted to housing and interconnected to the second flexible latch element for moving the second latch element between the latching and releasing positions.

Also, a reinforcing arm is attached to the main member and extends outwardly therefrom. The arm has a suction element on an outer end thereof for attached to the spa sidewall below the upper edge thereof. The release lock mechanism is a shaft having a ring at its outer end and being inserted through aligned holes in the auxiliary and main members.

These and other features and advantages of the present invention will become apparent to those skilled in the art upon a reading of the following detailed description when taken in conjunction with the drawings wherein there is shown and described an illustrate embodiment of the invention.

BRIEF DESCRIPTION OF THE DRAWINGS

In the following detailed description, reference will be made to the attached drawings in which.

DETAILED DESCRIPTION OF THE INVENTION

Figure 2:
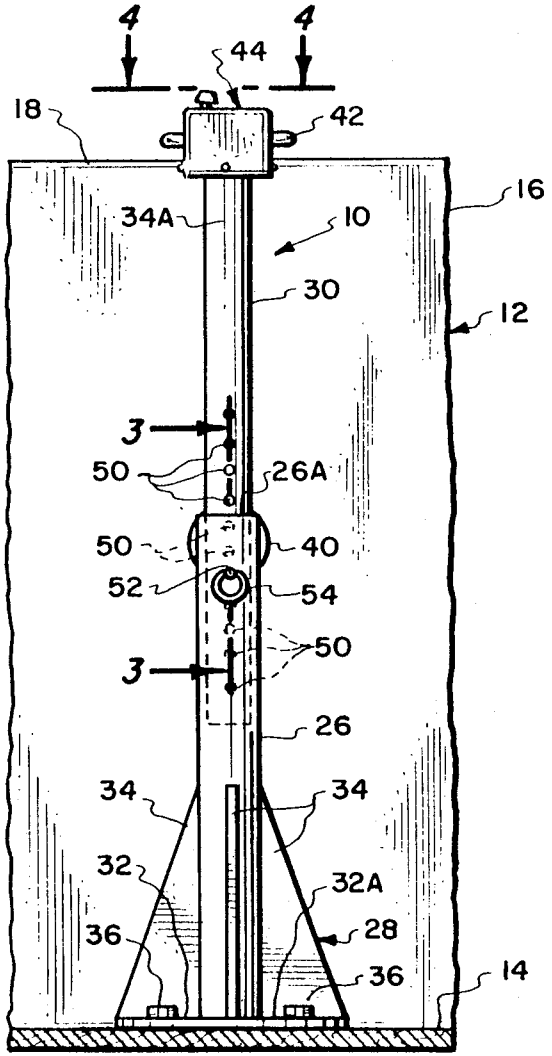
FIG. 2 is a rear end elevational view of the assist stand as seen along line 2—2 of FIG. 1.
Figure 1:
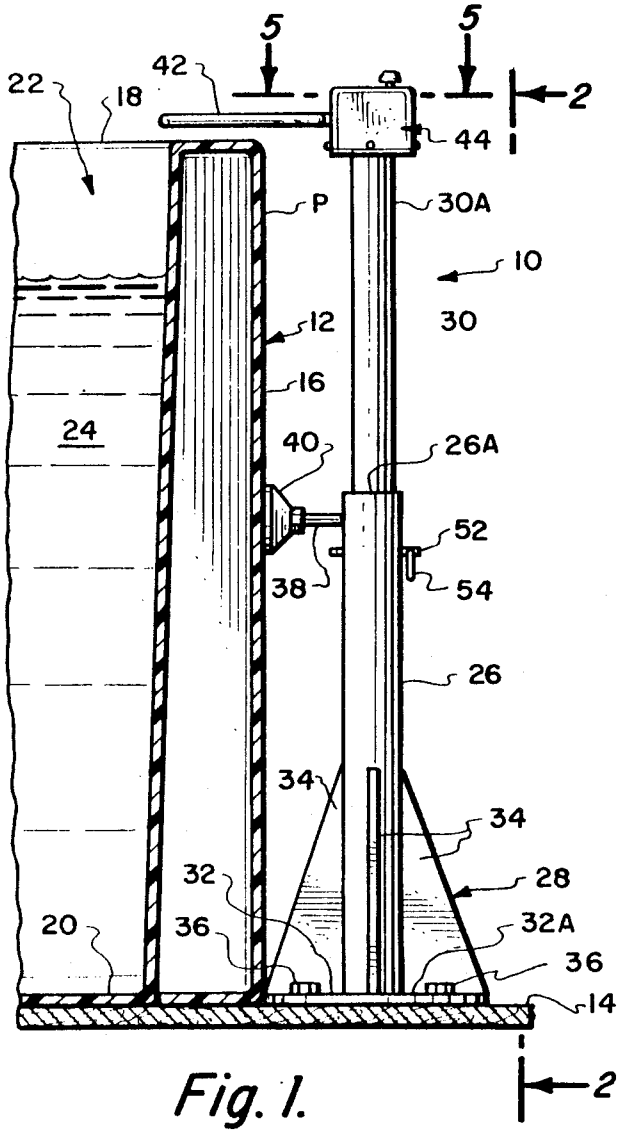
FIG. 1 is a side elevational view of a user assist stand of the present invention installed at an exterior side of a sidewall of spa which is shown in a fragmentary vertical sectional view.
Figure 4:
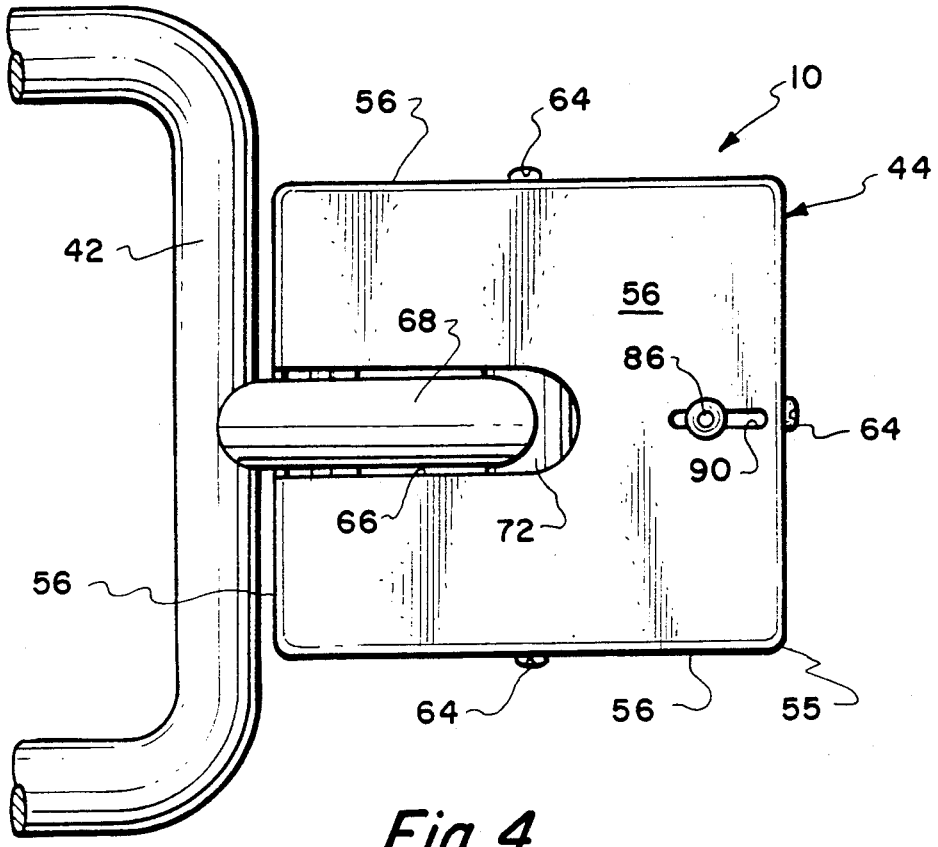
FIG. 4 is an enlarged fragmentary top plan view of a hand grip and swivel lock mechanism of the assist stand as seen along line 4—4 of FIG. 2.

Referring now to the drawings, and particularly to FIGS. 1 and 2, there is shown a user assist stand of the present invention, generally designated 10. The assist stand 10 is installed adjacent the exterior of a conventional spa 12. The spa 12 is installed upon and extends above the level of a floor or deck 14. The spa 12 has a continuous upright sidewall 16 with an upper edge 18 and a horizontal bottom wall 20. The bottom wall 20 and sidewall 16 define a reservoir 22 which contains a pool of water 24.

In its basic components, the user assist stand 10 includes an elongated main hollow tubular member 26, means 28 for securing the main tubular member 26 in an upright position at the exterior side of the spa sidewall 16, and an elongated auxiliary tubular member 30 which provides an extension of the main member 26 by slidably interfitting in telescoping relation within the main member 26 through an open top end 26A thereof. As an example, the securing means 28 is in the form of a base plate 32 and a plurality of braces 34. The base plate 32 is attached to the floor or deck 14 by several screws 36. The main member 26 is rigidly attached to the top surface 32A of the base plate 32, such as by being welded thereon, to permanently hold the main member 26 in the upright orientation. The braces 34, which reinforce the main member 26 in its upright orientation, are attached to and extend between the base plate 32 and main member 26.

Preferably, a reinforcing arm 38 is provided for stabilizing the upright main member 26 from the sidewall 16 of the spa 12. The arm 38 is fixed to and extends transversely outwardly from a side of the main member 26 and has a suction element 40 rotatably adjustably mounted on its outer end. The suction element 40 is attachable to the spa sidewall 16 below the upper edge 18 thereof.

The elongated auxiliary extension member 30 slidably interfits within the main member 26 such that an upper portion 30A of auxiliary member 30 is disposed upwardly from and is movable vertically relative to main member 26, more or less similar to a periscope. A hand grip 42 and swivel lock mechanism 44 are mounted on the upper portion 30A of the auxiliary member 30. A release lock mechanism 46 is provided for securing the auxiliary member 30 to the main member 26 to position the upper portion 30A of the auxiliary member 30 and thereby the hand grip 42 at a desired elevation above the main member top end 26A and relative to the upper edge 18 of the spa 12.

Figure 3:
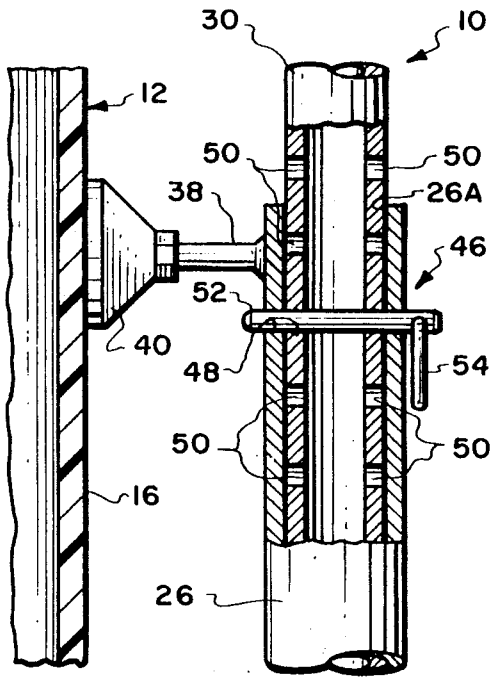
FIG. 3 is an enlarged longitudinal sectional view of a release lock mechanism of the assist stand taken along line 3—3 of FIG. 2.

Referring to FIG. 3, the release lock mechanism 46 preferably includes a pair of aligned holes 48 defined through opposite side portions of the main member 26 and spaced below its top end 26A, and a pair of rows of aligned holes 50 defined through and longitudinally spaced along opposite side portions of the auxiliary member 30. The mechanism 46 also includes a pin or shaft 52 having a gripping ring 54 at its one end which can be inserted through one pair of the aligned holes 50 in the auxiliary member 30 which are also aligned with the pair of aligned holes 48 in the main member 26.

A particular pair of holes 50 in the auxiliary member 30 are selected to receive the shaft 52 in order to place the upper end 30A of the auxiliary member 30 and the hand grip 42 thereon at the desired height. By merely removing the shaft 52 from the auxiliary and main members 30, 26, the auxiliary member 30 can then be slidably adjusted vertically relative to the main member 26 to place the hand grip 42 at a different desired elevation above the upper edge 18 of the spa sidewall 16. A different pair of holes 50 in the auxiliary member 30 can be aligned with the pair of holes 48 in the main member 26 and the shaft 52 reinserted to lock the auxiliary member 30 at the new adjusted position.

Referring to FIGS. 4–7, there is illustrated in greater detail the hand grip 42 and swivel lock mechanism 44 of the assist stand 10. The hand grip 42 is preferably in the configuration of a ring mounted to the swivel lock mechanism 44. The swivel lock mechanism 44 includes a housing 55 fixedly mounted to upper portion 30A of the auxiliary member 30. The housing 55 is composed of an outer cover 56 and inner, partial side walls 58. The cover 56 has a square box-like shape and is interconnected to the side walls 58 and a bottom wall 60. The cover 56 has a slot or opening 66 formed therein permitting passage of an extension 68 of the hand grip 42 into the cover 56 when the cover 56 is fastened to the side walls 58 with screws 64.

Also, in addition to the cover 56, the swivel lock mechanism 48 includes an inner first shaft 70 transversely extending between and fixed to a pair of the opposite side walls 58 of the housing 55, and an outer hollow second shaft 72 inserted over the inner first shaft 70 and rotatable relative thereto. The extension 68 of the hand grip 42 which passes through the cover opening 66 is fixed attached to the middle of the outer second shaft 72 for pivoting with rotation of the outer second shaft 72.

Figure 7:
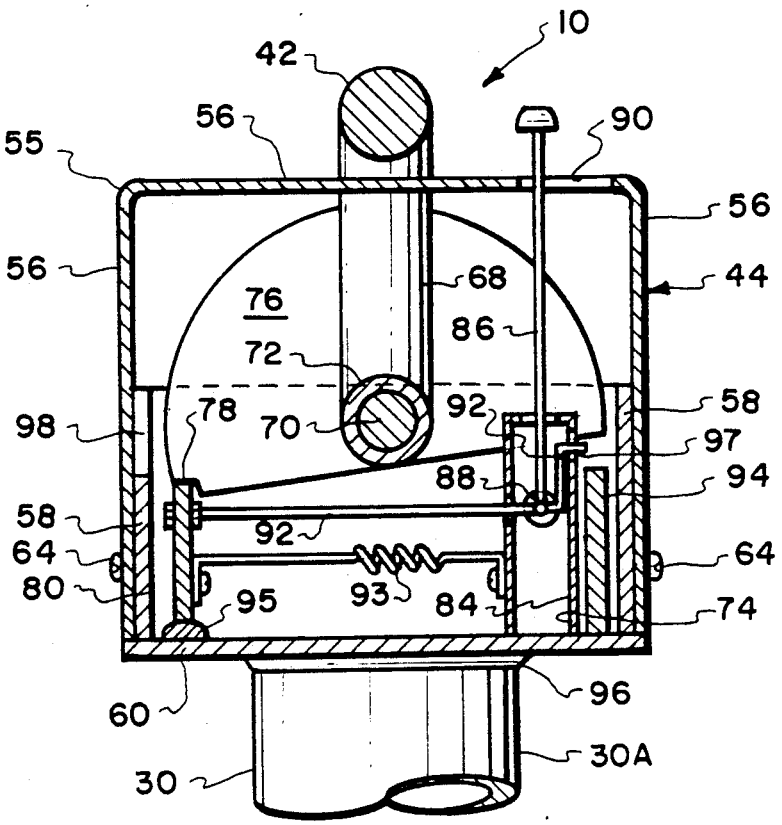
FIG. 7 is a view similar to that of FIG. 6 but illustrating the hand grip in a retracted position.

Also, the swivel lock mechanism 48 includes means 74 for latching the hand grip 42 at its retracted vertical position as seen in FIG. 7. The latching means 74 is releasable for permitting pivotal movement of the hand grip 42 to the extended horizontal position.

Figure 5:
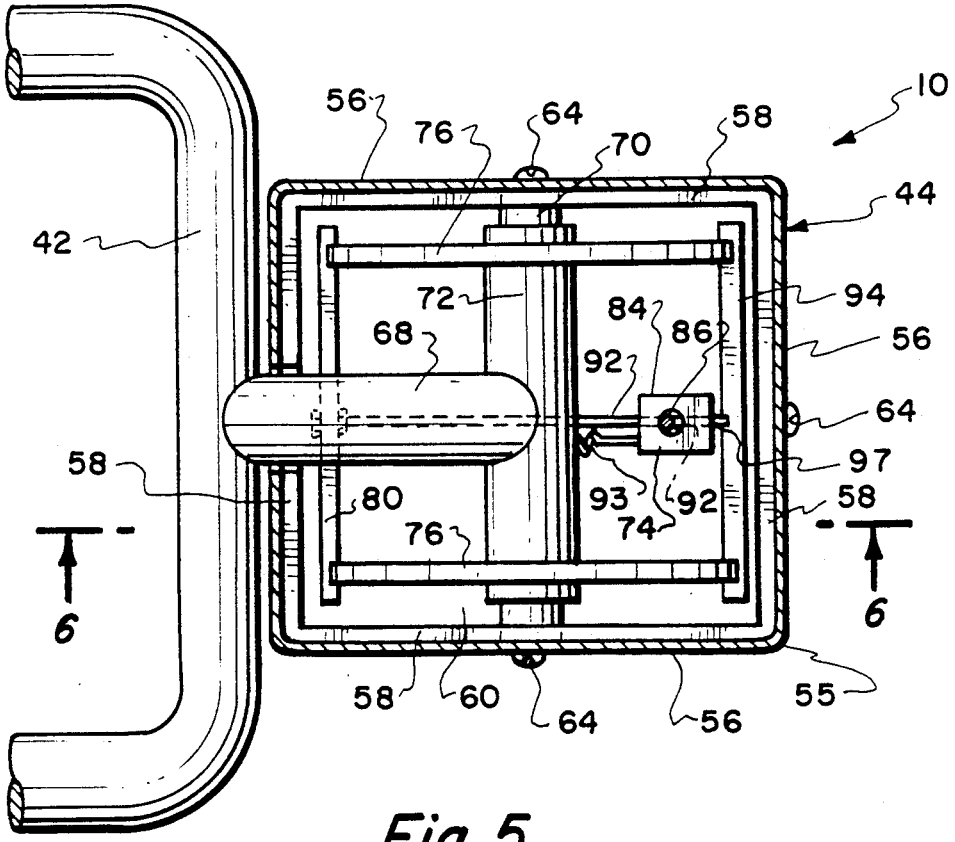
FIG. 5 is a view similar to that of FIG. 4 but taken along line 5—5 of FIG. 1 and with the top cover of the swivel lock mechanism removed.
Figure 6:
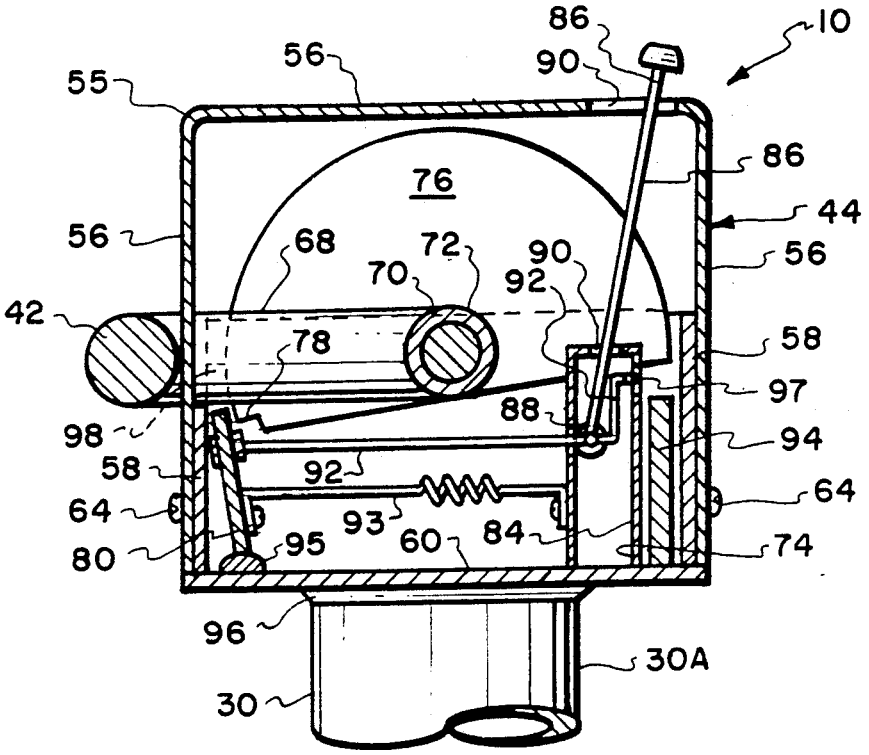
FIG. 6 is a vertical sectional view of the hand grip and swivel lock mechanism of the assist stand taken along line 6—6 of FIG. 5 illustrating the hand grip in an extended position.

The latching means 74 includes a first latch element 76 in the form of a pair of laterally spaced semi-circular shaped discs fixed adjacent to the opposite ends of the outer rotatable shaft 72 and extending upwardly, rearwardly and forwardly thereof, as seen in FIGS. 5 and 6. Each of the first latch element discs 76 has a notch 78 defined in its lower forward corner. The latching means 74 also includes a second flexible latch element 80 in the form of a strip of resiliently flexible material mounted to the bottom wall 60 of the housing 55 adjacent the front edge thereof and extending across the housing. The upper end of the latch element flexible strip 80 is normally disposed and aligned in a latching position below the notch 78 in each respective first latch element disc 76 where it extends into the notches 78 and locks the first latch element discs 76 and therewith the hand grip 42 in the retracted vertical position seen in FIG. 7. In such latching position, the strip 80 locks the first latch element discs 76 by preventing them from rotating counterclockwise as seen in FIG. 7. The latch element flexible strip 80 can be deflected forwardly of the notches 78 to the releasing position seen in FIG. 6 for permitting the first latch element discs 76 to clear the upper edge of the strip 80 and rotate counterclockwise and therewith the hand grip 42 to pivot from the retracted position of FIG. 7 toward the extended horizontal position of FIG. 6.

The latching means 74 further includes an actuating device pivotally mounted to an pedestal 84 mounted upright on the bottom wall 60 of the housing 55. The device 92 includes a lever arm 86 connected at its lower end to a pivot pin 88 and extending upward through a slot 90 in the cover 56 so that the lever arm can be pivoted when the cover 56 is applied around the side walls 58. Cover 56 is attached with screws 64. The link arm 92 connects with the lower end of the lever arm 86 and the latches element strip 80 and 94 locking 76 at 78 and 97 as seen in FIG. 7. Pivoting of the lever arm 86 counterclockwise causes the link arm 92 to push the latch element strip 80 and 97 to the deflected position as seen in FIG. 6 permitting element disc 76 to rotate and the hand grip 42 to pivot from their respective positions of FIG. 6. A return spring 93 extends between the strip 80 and the pedestal 84 and biases the strip 80 to the normal latching position shown in FIG. 7.

The swivel lock mechanism 44 further includes a stop 94 mounted to bottom wall 60 of the housing 55 adjacent its rear edge for engaging the first latch element discs 76 and preventing further rotation thereof upon the hand grip 42 reaching the retracted vertical position as seen in FIG. 7.

As mentioned above, the extension 68 of the hand grip 42 is fixedly attached to the transverse tubular outer shaft 72 being rotatably mounted within housing 55. Such mounting relationship, permits pivotal or swivel-type movement of the hand grip 42 between the extended horizontal and retracted vertical positions, as shown in FIGS. 6 and 7. As seen in FIG. 1, in its extended horizontal position, the hand grip 42 overlies a portion of the upper edge 18 of the spa sidewall 16, whereas in its retracted vertical position the hand grip 42 will be offset away from and outside of a vertical plane P defined by the sidewall 16 of the spa 12. The ring 42 is placed in its extended position during period of use of the spa 12, and stored in its retracted position during periods of non-use of the spa 12. In the retracted position of the ring 42, a thermal cover (not shown) can easily be slipped over the spa 12 without interference with the assist stand 10.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A user assist stand for use with an above-floor level spa, said assist stand comprising:

(a) an elongated main hollow tubular member having an open top end;

(b) means for securing said main member to a floor and extending upright adjacent an exterior side of a sidewall of a spa;

(c) an elongated auxiliary extension member slidably interfitting in telescoping relation within said main member through said open top end thereof such that an upper portion of said auxiliary member is disposed upwardly from said main member;

(d) hand grip means for assisting a user to enter or leave the spa; a swivel lock mechanism for mounting said hand grip to said upper portion of said auxiliary member wherein said hand grip means lockingly swivels from a horizontal position to a vertical position; and (e) a release lock mechanism operable for securing said auxiliary member to said main member to position said upper portion of said auxiliary member and said hand grip means mounted thereon at a desired elevation above said main member and relative to an upper edge of the spa sidewall, said release lock mechanism also being operable for releasing said auxiliary member from securement to said main member to permit slidable movement of said auxiliary member relative to said main member and thereby adjustment of the elevation of said upper portion of said auxiliary member and said hand grip means thereon relative to the main member and the spa sidewall.

2. The stand of claim 1 wherein said securing means includes a base plate, said main member at a bottom end thereof being rigidly attached to said base plate.

3. The stand of claim 2 wherein said securing means further includes a plurality of braces attached to and extending between said main member and said base plate for reinforcing said main member in the upright position on said base plate.

4. The stand of claim 1 wherein said hand grip means is a hand grip, and said swivel lock mechanism is operable to permit pivotal movement of said hand grip between an extended position in which it overlies a portion of the upper edge of the spa sidewall and a retracted position in which it is offset away from and outside of a vertical plane defined by the sidewall of the spa.

5. The stand of claim 4 wherein said swivel lock mechanism includes:

a support structure;

a first shaft fixed to said support structure;

a second hollow shaft inserted over said first shaft and rotatable relative thereto, said hand grip being attached to said second shaft for pivoting with rotation of said second shaft; and means for latching said hand grip at one of said extended and retracted positions and being releasable for permitting pivotal movement of said hand grip to the other of said positions.

6. The stand of claim 5 wherein said latching means includes:

a first latch element fixed to said rotatable shaft and having a notch defined therein;

a second flexible latch element mounted to said support structure adjacent said first latch element and movable between latching and releasing positions relative to said notch of said first latch element; and an actuating device pivotally mounted to said support structure and interconnected to said second flexible latch element for moving said second latch element between said latching and releasing positions.

7. The stand of claim 6, wherein said support structure is a housing having a removable cover with an opening for passage of a portion of said hand grip therethrough.

8. The stand of claim 6, wherein said swivel lock mechanism further includes a stop mounted to said support structure for engaging said first latch element and preventing further rotation thereof upon said hand grip reaching said latching one of said positions.

9. The stand of claim 1 further comprising:

a reinforcing arm attached to said main member and extending outwardly therefrom, said arm having an element on an outer end thereof for attachment to the spa sidewall below the upper edge thereof.

10. The stand of claim 1 wherein said release lock mechanism includes:

means defining a plurality of alignable holes in said main and auxiliary members; and a shaft having a gripping element at one outer end and being insertable at an opposite end through selected aligned ones of said holes in said main and auxiliary member.

11. A user assist stand for use with an above-floor level spa, said assist stand comprising:

(a) a base plate for securement to a floor;

(b) an elongated main tubular member secured upright on said base plate and having a top open end;

(c) an elongated auxiliary extension member slidably interfitting in telescoping relation within said top open end of said main member such that an upper end portion of said auxiliary member extends upwardly from said main member;

(d) hand grip means for assisting a user to enter or leave the spa;

(e) a swivel lock mechanism mounting said hand grip means to said upper portion of said auxiliary member and being operable to permit pivotal movement of said hand grip means between an extended position in which it overlies a portion of the upper edge of the spa sidewall and a retracted position in which it is offset away from and outside of a vertical plane defined by the sidewall of the spa; and (f) a release lock mechanism mounted to said main member and being operable for securing said auxiliary member to said main member to position said upper end portion of said auxiliary member and said hand grip means thereon at a desired elevation above said main member and relative an upper edge of a spa, said lock mechanism also being operable for releasing said auxiliary member for permitting slidable adjusting of the position thereof relative to said main member.

12. The stand of claim 11 further comprising:

a reinforcing arm attached to said main member and extending outwardly therefrom, said arm having a suction element on an outer end thereof for attached to the spa sidewall below the upper edge thereof.

13. The stand of claim 11 wherein said release lock mechanism includes:

means defining a plurality of alignable holes in said main and auxiliary members; and a shaft having a gripping element at one outer end and being insertable at an opposite end through selected aligned ones of said holes in said main and auxiliary member.

14. The stand of claim 11 further comprising:

a plurality of braces attached to and extending between said main member and said base plate for reinforcing said main member in the upright position on said base plate.

15. The stand of claim 11 wherein said swivel lock mechanism includes:

a support structure;

a first shaft fixed to said support structure;

a second hollow shaft inserted over said first shaft and rotatable relative thereto, said hand grip means being attached to said second shaft for pivoting with rotation of said second shaft; and means for latching said hand grip means at one of said extended and retracted positions and being releasable for permitting pivotal movement of said hand grip means to the other of said positions.

16. The stand of claim 15 wherein said latching means includes:

a first latch element fixed to said rotatable shaft and having a notch defined therein;

a second flexible latch element mounted to said support structure adjacent said first latch element and movable between latching and releasing positions relative to said notch of said first latch element; and an actuating device pivotally mounted to said support structure and interconnected to said second flexible latch element for moving said second latch element between said latching and releasing positions.

17. The stand of claim 16, wherein said support structure is a housing having a removable cover with an opening for passage of an portion of said hand grip means therethrough.

18. The stand of claim 16, wherein said swivel lock mechanism further includes a stop mounted to said support structure for engaging said first latch element and preventing further rotation thereof upon said hand grip means reaching said latching one of said positions.

* * * * *